US005513207A

United States Patent [19]

Kavia

[11] Patent Number: 5,513,207

[45] Date of Patent: Apr. 30, 1996

[54] MELTING FURNACE AND METHOD

[75] Inventor: Mukund N. Kavia, Corona, Calif.

[73] Assignee: Thermal Kinetic Systems, Inc., Pomona, Calif.

[21] Appl. No.: 370,381

[22] Filed: Jan. 9, 1995

[51] Int. Cl.[6] ..... F27D 3/00

[52] U.S. Cl. ..... 373/116; 373/79; 373/85; 65/27; 75/671

[58] Field of Search ..... 373/85, 79, 116, 373/122, 130, 133; 75/10.21, 678, 671; 110/90; 65/27; 252/373; 208/7

[56] References Cited

U.S. PATENT DOCUMENTS 3,561,377 2/1971 Amundsen ..... 110/8
3,984,234 10/1976 Claxton et al. ..... 75/671
4,007,036 2/1977 Gottschol et al. ..... 75/678
4,166,830 9/1979 Guth et al. ..... 252/373
4,544,394 10/1985 Hnat ..... 65/27
4,997,476 3/1991 Lindsay et al. ..... 75/10.21

*Primary Examiner*—Tu Hoang
*Attorney, Agent, or Firm*—Beehler & Pavitt

[57] ABSTRACT

An aluminum can melting furnace in which a slip stream of molten material is diverted from a main molten bath in the furnace, a vortex is formed in the diverted slip stream, and thin walled aluminum can feedstock is introduced into the vortex. The feedstock is immediately drawn under the surface of the vortex in the slip stream so the feedstock melts before it has a chance to oxidize. Hydrocarbons which are introduced with the feedstock are flash vaporized in the vortex. The hydrocarbon vapors are captured and conducted to the furnace burner where they are burned to increase the efficiency of the operation and reduce the pollution generated by the process.

7 Claims, 2 Drawing Sheets

MELTING FURNACE AND METHOD

BACKGROUND OF THE INVENTION

1. Field of the Invention

The invention relates in general to apparatus and method for melting furnaces, and, in particular, to method and apparatus for melting furnaces which are particularly adapted to the efficient melting of finely divided materials in the presence of oxygen without excessive oxidation.

2. Description of the Prior Art

Previous furnaces for melting finely divided materials in air, such as, for example, thin walled aluminum cans, often permitted excessive oxidation of the feedstock. This significantly reduced the efficiency of the operation. Previous expedients generally introduced the feedstock onto the surface of a molten mass and allowed the finely divided feed stock to melt down into the mass. Thin walled aluminum can feedstock, for example, oxidizes rapidly, and sometimes even ignites, as soon as it reaches its melting point. Because of the physical form of thin walled cans they are particularly difficult to melt efficiently.

Many times, for example, thin walled can feedstock, as delivered to a melting furnace, contains hydrocarbon materials in the form of paint or lacquer on the can, or residues of product within the can. Previously, disposing of these hydrocarbons safely, efficiently and without polluting was difficult.

Melting furnaces are generally operated to turn finely divided metallic feedstock into ingots. Previously it had been generally impossible to operate such melting furnaces efficiently in ambient air without releasing significant pollutants.

These and other difficulties of the prior art have been overcome according to the present invention.

BRIEF SUMMARY OF THE INVENTION

The melting furnaces and methods according to the present invention generally comprise a melting furnace, for example, in which the atmosphere is ambient air, and includes a chamber for holding a molten mass, a heat source, and some means for forcibly immersing feedstock below the surface of the molten mass as soon as it is introduced into the furnace, and in any event, before the feedstock is heated to the temperature where rapid oxidation occurs. In general the melting furnace is provided with particulate and other pollution control devices for the gas phase exhaust which is discharged from the furnace.

According to one preferred embodiment of the present invention, a metal melting furnace which is open to the ambient air includes a furnace chamber for holding a molten mass, a burner for supplying heat to the molten mass in the furnace chamber, an external circulation loop for conducting a slip stream of the molten mass away from and returning it to the furnace chamber, a vortex chamber in the external circulation loop, a vortex generator associated with the vortex chamber, a feedstock supply port associated with the vortex chamber, and a hydrocarbon vapor collection system associated with the vortex chamber for collecting hydrocarbon vapor and delivering it to the burner.

According to one form of the invention, the atmosphere within the furnace chamber is drawn at least in part from the ambient atmosphere so that it contains some oxygen. At the operating temperatures involved in melting metals, oxidation occurs very rapidly.

In general the intended feedstock is finely divided so that it presents many times the surface area of the top surface of the bath of molten mass. Thin walled aluminum cans, crushed, uncrushed, chopped or ground are finely divided as are powders, granules and chopped materials. In general, the feedstock is metallic in nature and the desired output from the furnace is the metal in ingot form. The feedstock, because of its finely divided physical form, is generally more susceptible to oxidation than the bath, even when the exposed surface of the bath is unprotected. Thus, the feedstock must generally be protected from oxidation more than the bath. The top surface of the bath may, if desired, be protected from oxidation, for example, by forming a molten blanket of some other material, such as, for example, a molten salt, on its surface. The finely divided feedstock is protected from oxidation by immersing it in the molten mass as soon as it is introduced into the furnace and before it reaches its melting point.

The external circulation loop, for example, carries a stream of the molten mass away from the furnace chamber, through a vortex chamber, and back to the furnace chamber. Feedstock is conveniently introduced to the furnace in this external circulation loop. Various reactants for various purposes may also be introduced into the diverted stream of molten mass as it flows through the external circulation loop. In general the stream is moved through the external loop under the urging of some pumping action. Because some cooling usually takes place in the external loop it is generally preferred, although not essential, that the stream be returned to the furnace chamber at some location which is physically removed from the location where the stream is withdrawn from the furnace chamber. For purposes of convenience and simplicity of design it is generally preferred that the external loop conduct the stream along a path which is generally level and at approximately the same horizontal level as the bath in the furnace chamber. The stream may, however, if desired, be pumped to different levels.

The vortex generator creates a vortex in the vortex chamber. The vortex is formed in the stream of molten mass as it flows through the external circulating loop. The finely divided feedstock is introduced through a feedstock supply port to a location where the feedstock is immediately drawn into the vortex. The vortex draws the feedstock under the surface of the molten stream where it is quickly heated to its melting point out of contact with air. The feedstock becomes part of the stream of molten mass and flows back to the furnace chamber along the external circulation loop. The diverted stream of molten mass may be composed of molten feedstock alone or it may include or be composed entirely of bath blanket material, if a blanket is present, and molten feedstock. Oxidation of the feedstock is thus minimized and a maximum amount of the feedstock is recovered in the desired metallic form.

The finely divided feedstock often carries with it some hydrocarbon materials. The temperature of the molten mass in the vortex is sufficiently high to cause the hydrocarbon materials to vaporize immediately and escape from the molten mass. Preferably, the vaporized hydrocarbons are collected in a headspace over the vortex, and that headspace is vented to the fuel supply for the burner which heats the molten mass in the furnace chamber. If desired, the vapors may be collected downstream from the vortex chamber. Thus, the hydrocarbon materials in the feedstock serve to reduce the amount of purchased fuel which is required to heat the furnace chamber. Where the feedstock contains hydrocarbons which will be vaporized, it is generally preferred that the collection site, for example, the headspace portion of the vortex chamber, be sealed from the flame of the burner so as to prevent any unevenness in the rate of the generation of the vapor from creating an explosive mixture which might be ignited by the open flame of the burner.

The vortex generator may conveniently take the form of a pump. According to a preferred embodiment the vortex generator is in the form of a paddle which rotates at a rate which is sufficient to form the vortex in the molten mass and drawn the feedstock down immediately upon its introduction. The vortex generator may also serve to pump the stream of molten mass through the external circulating loop.

The feedstock may contain elements which are not desired in the metallic ingots which are the intended end product of the process. If, for example, the metallic ingots are intended to be aluminum and the feedstock contains, for example, some copper, various materials may be added to react with the copper to place it in a separable form. Removal of such elements may be accomplished, for example, by adding substances which react with the undesired elements to form compounds which may be physically separated from the molten bath. Preferably, the compounds are immiscible with and of a different density from the molten feedstock so that they form a removable layer above or below the layer of molten feedstock in the furnace chamber. The reactants are conveniently added to the stream of molten mass in a reaction chamber along the external circulation loop.

Melting furnaces according to the present invention are particularly suited for use where the atmosphere in the furnace chamber includes oxygen, the heat source is a burner, and the feedstock is a metal. Such furnaces are, however, also suitable for use in other reactive ambient atmospheres and with nonmetallic feedstock materials. Other heat sources, such as, for example, induction heating and the like, may be employed, if desired. Such furnaces may also be useful where the feedstock is subject to oxidation for reasons in addition to or apart from its physical form.

The feedstock may be delivered to the furnace by means, for example, of a gravity feed chute, a screw feeder, or the like. The feedstock supply port is generally positioned so as to discharge feedstock directly into the headspace over the vortex so that the entering feedstock is immediately drawn under the surface of the molten mass. The feedstock supply port preferably is at least partially sealed so as to prevent the escape of the gas phase from the headspace region of the vortex chamber into the atmosphere.

Generally, the furnace is placed in operation by heating a mass of material which may be feedstock or bath blanket material, or both, until it is well above its melting point. The vortex generator is activated so as to form the vortex, and feedstock is introduced into the vortex. The operation is preferably conducted as a continuous process with feedstock being introduced continuously, although it may be operated as a batch process, if desired.

According to an alternative and generally less preferred arrangement the feedstock supply port directs feedstock generally into a submersible basket which is positioned generally above the molten mass. As soon as the submersible basket is loaded with finely divided feedstock it is submerged within the molten mass, carrying the feedstock with it. After the feedstock is melted the submersible basket is withdrawn from the molten mass and recharged with feedstock. The submersible basket is preferably positioned in an external circulation loop but it may be positioned within the furnace chamber. In general a vortex need not be formed when a submersible basket is employed. The batch nature of the supply of the feedstock risks oxidizing the feed stock before it is immersed in the bath. In general the finely divided feedstock is subject to rapid oxidation, that is it may ignite or burn in less than 30 seconds after being introduced into the furnace. If the basket is not submerged within less than 30 seconds some of the feedstock will probably be lost due to oxidation.

BRIEF DESCRIPTION OF THE DRAWINGS

Referring particularly to the drawings for the purposes of illustration and not limitation.

DETAILED DESCRIPTION OF THE PREFERRED EMBODIMENTS

Figure 1:
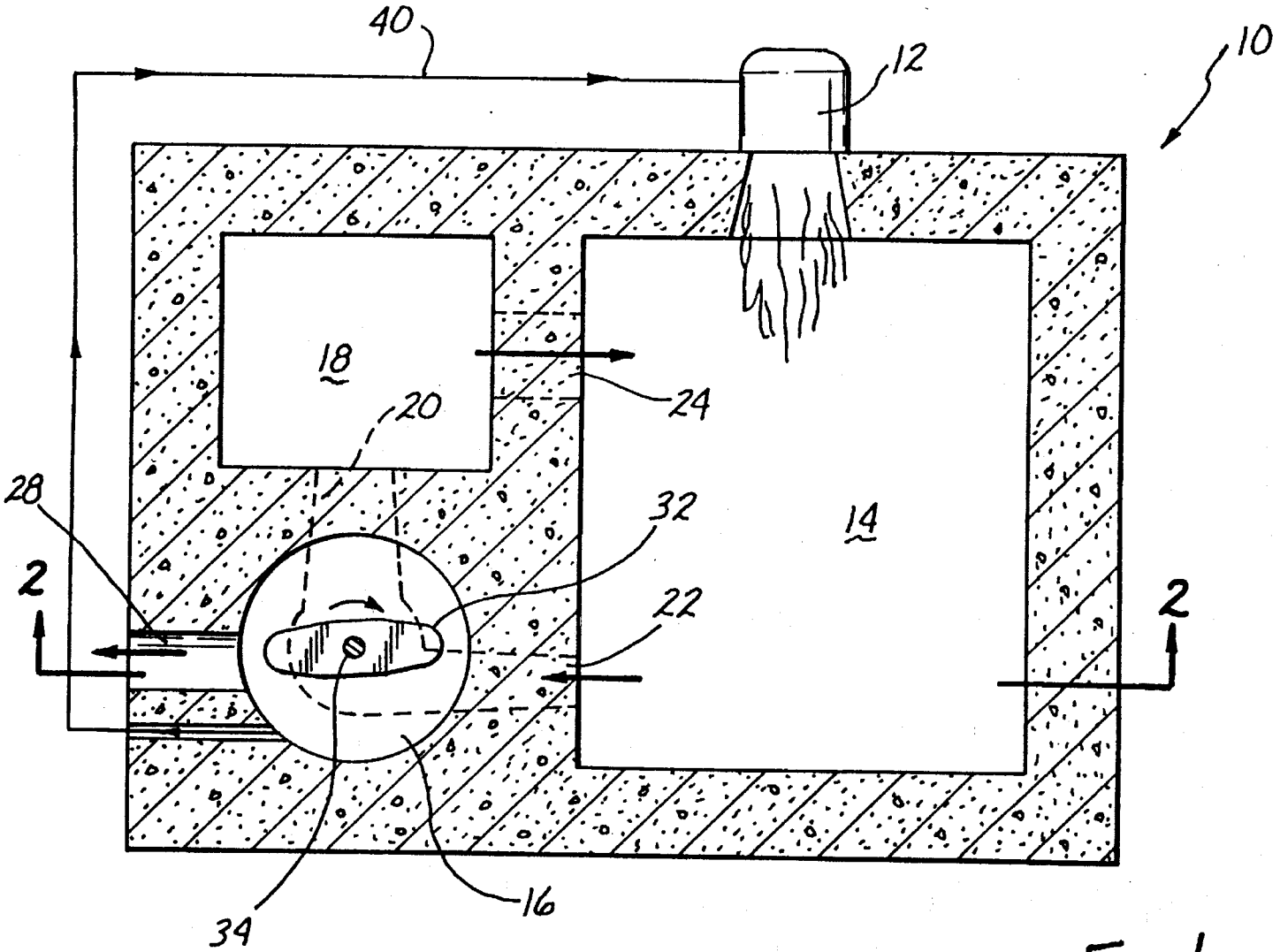
FIG. 1 is a cross-sectional simplified schematic view of a preferred embodiment of the invention.
Figure 2:
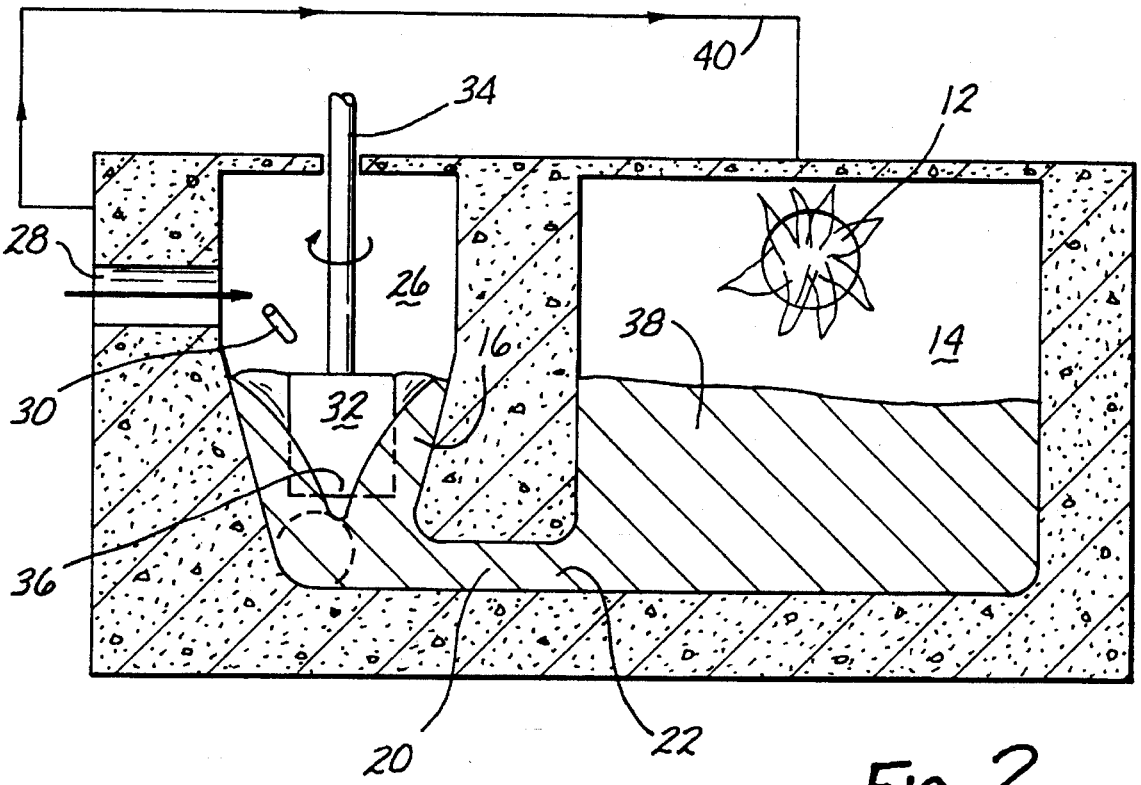
FIG. 2 is a cross-section view taken along line 2—2 in FIG. 1.

Referring particularly to the drawings, in the preferred embodiment which is referred to for purposes of illustration, in FIGS. 1 and 2, there is schematically illustrated generally at 10, a melting furnace. Melting furnace 10 includes, for example, burner 12, and a melting or furnace chamber 14. A vortex chamber 16 and a mixing chamber 18 are positioned, for example, along an external circulation loop 20. Loop 20 extends between exit port 22 and entrance port 24. Vortex chamber 16 includes a headspace region 26. A feedstock supply port 28 is preferably positioned so as to deliver feedstock 30 to the vortex chamber 16. A vortex generator, for example, paddle 32, rotatably driven by shaft 34, is positioned in vortex chamber 16. The heat generated by the burner 12 causes material in furnace chamber 14 to melt so as to form a molten mass in the form of a bath 38. The molten mass fills external circulation loop 20, including vortex chamber 16 and mixing chamber 18. In vortex chamber 16 the rotation of paddle 32 causes the formation of a vortex 36 in the stream of molten material which is flowing through the external circulation loop 20. The headspace region 26 in vortex chamber 16 is, for example, vented to burner 12 by means of a vapor conduit 40, whereby any vaporized hydrocarbons which appear in headspace region 26 are burned as auxiliary fuel in burner 12.

Melting furnace 10 is conveniently constructed of conventional furnace construction materials. Paddle 32 may conveniently be constructed, for example, of ceramic materials which are substantially unaffected by either the operating temperatures within the furnace or the molten mass within the furnace.

This invention finds particular utility where the desired metallic ingots are aluminum and the feedstock is thin walled cans. In this preferred operation the burner 12 operates at a temperature of approximately 1700 degrees Fahrenheit and the bath 38 is at a temperature of approximately 1375 degrees Fahrenheit. The bath 38 must be at a temperature which is sufficiently above the melting point of the aluminum to prevent the slip or side stream in the external circulation loop 20 from solidifying while it is separated from the main bath. When a sufficient quantity of the feedstock 30 has been melted the furnace is tapped to release a stream of the molten feedstock into an ingot forming receptacle (not shown).

The paddle 32 is rotated at a rate which is sufficient to establish a strong vortex 36. When the bath 38 is primarily molten aluminum and the bath is approximately 10 inches deep the paddle should be rotated at a rate of from approximately 400 to 1500 revolutions per minute. A rotational rate of 400 revolutions per minute is generally sufficient to establish the vortex 36. If substantial quantities of feedstock 30 are introduced at a rapid rate the rate of rotation of the paddle 32 may have to be increased to as much as 1500 revolutions per minute so as to submerge the feedstock quickly enough to prevent excessive oxidation. The action of the paddle 32 also serves to pump the molten mass along the external circulation loop 20. This pumping action needs to be quite strong where the slip stream is being cooled quickly by the rapid introduction of cold feedstock into the vortex. If the liquid phase slip stream were to be cooled to the point of phase transition to the solid phase the results would be disastrous to the operation of the furnace. The efficiency of the operation is improved and a pollution control problem is eliminated by using the hydrocarbon vapors which are generated during the melting of cans to help heat the bath 38 in chamber 14.

Any lacquer, paint or other organic residues which are introduced with the feedstock are generally volutilized very rapidly so that they escape from the molten mass into the headspace region 26. Submersing the feedstock immediately tends to improve the yield of hydrocarbon vapors and reduce the production of elemental carbon. This improves the efficiency of the operation because the hydrocarbon vapors are directed to the burner 12 where they are burned off as auxiliary fuel. This also avoids the necessity of collecting these hydrocarbons in some other vapor or solid phase to prevent them from being vented to the environment. The gas phase exhaust from the furnace is treated by conventional pollution control equipment and procedures.

Figure 3:
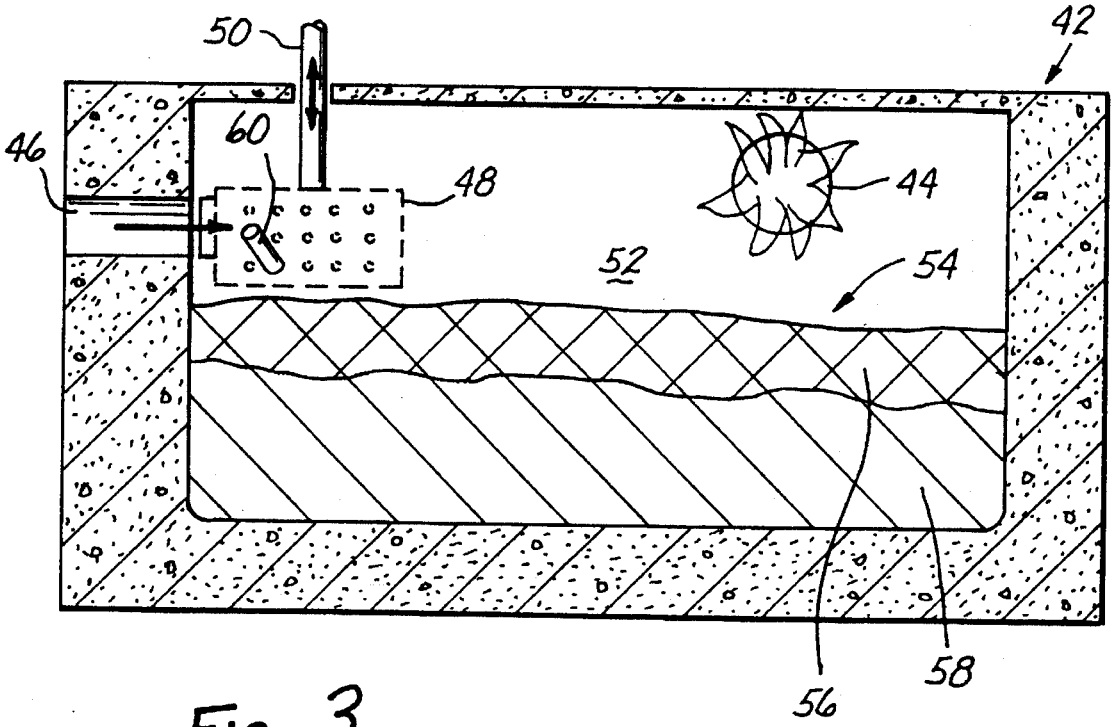
FIG. 3 is a cross-sectional view similar to FIG. 2, of a different furnace.

Referring particularly to FIG. 3, a melting furnace is illustrated schematically at 42. Melting furnace 42 includes a burner 44, a furnace chamber 52, a feedstock supply port 46, and a perforated submersible basket 48 mounted for reciprocal motion with reciprocating shaft 50. Heat generated by burner 44 melts the material which is in furnace chamber 52 to form a molten mass indicated generally at 54. In the embodiment chosen for illustration in this embodiment the molten mass 54 is composed of a blanket layer 56 and a layer 58 of molten metal. The blanket layer, which may conveniently be molten salt, serves to protect the surface of the molten metal layer 58 from oxidation. Finely divided feedstock 60 is introduced through supply port 46 into basket 48 which is then submerged below the surface of molten mass 54 by the action of shaft 50. When the feedstock in basket 48 has been rendered molten the basket is raised by shaft 50 to a position to receive more feedstock. If volatile hydrocarbons are released from the feedstock submersion should take place in a separate chamber where the vapors are no exposed to the open flame of the burner 44.

Molten bath blankets may be used with any form of the present invention although they are generally not needed where aluminum is the desired product.

What has been described are preferred embodiments in which modifications, changes, substitutions and reversals may be made without departing from the spirit and scope of the accompanying claims.

What is claimed is:

1. A furnace for melting finely divided oxidizable feedstock comprising:

a chamber adapted to hold a molten mass which is generally exposed to air, a heat source positioned to supply heat to said molten mass, a vortex region adapted to contain a vortex formed of said molten mass, a vortex generator associated with said vortex region and adapted to generate said vortex including a vortex surface, and a feedstock supply port positioned to discharge finely divided oxidizable feedstock onto said vortex surface.

2. A furnace for melting finely divided oxidizable feedstock comprising:

a chamber adapted to hold a molten mass, a heat source comprising a burner positioned to supply heat to said molten mass, a vortex region generally isolated from said burner and adapted to contain a vortex formed of said molten mass, a vapor conduit positioned to conduct vapors from generally said vortex region to said heat source, and a feedstock supply port positioned to discharge finely divided oxidizable feedstock into said vortex region.

3. A furnace for melting finely divided oxidizable feedstock comprising:

a furnace chamber adapted to hold a molten mass, a heat source positioned to supply heat to said molten mass, an external circulation loop positioned to receive said molten mass and conduct it away from and back to said furnace chamber, a vortex chamber positioned along said external circulation loop and adapted to contain a vortex formed of said molten mass, and a vortex generator associated with said vortex chamber positioned to generate a vortex having a vortex surface in the molten mass in said vortex chamber, and a feedstock supply port positioned to discharge finely divided oxidizable feedstock onto said vortex surface.

4. A method of melting finely divided oxidizable feedstock comprising:

applying heat to a material in a first region to form a molten mass, said heat being generated at least in part by burning a hydrocarbon containing fuel in a burner, forming a vortex in said molten mass in a second region, said second region including a generally enclosed headspace above said vortex, said enclosed headspace being isolated from said burner, said vortex including a vortex surface, adding finely divided oxidizable feedstock including hydrocarbon materials to said vortex surface, and allowing said feedstock to be drawn under the surface of the molten mass by the vortex before it is heated to a temperature at which it would be rapidly oxidized, whereby oxidation of said finely divided feedstock is minimized, allowing said hydrocarbon materials to vaporize and collect in said enclosed headspace, and conducting the resultant vaporized hydrocarbon materials away from said enclosed headspace.

5. A method of melting finely divided oxidizable feedstock comprising:

applying heat to a material in the presence of air to form a bath comprising a molten mass of said material, diverting a stream of said bath to a vortex forming location, forming a vortex in said stream at said vortex forming location, said vortex having a vortex surface, adding finely divided oxidizable feedstock onto said vortex surface, and allowing said feedstock to be drawn under the surface of the stream by the vortex before the finely divided oxidizable feedstock is heated to a temperature at which it would be rapidly oxidized, whereby oxidation of said finely divided feedstock is minimized, and returning said stream to said bath.

6. A method of claim 5 wherein said feedstock includes hydrocarbon material, and said method of melting includes conducting vapor phase hydrocarbon material away from said stream of molten mass.

7. A method of claim 6 wherein said oxidizable feedstock is finely divided.

* * * * *